US005704308A

United States Patent [19]

Anderson

[11] Patent Number: 5,704,308

[45] Date of Patent: Jan. 6, 1998

[54] PIVOTAL AFTERPLANE HAVING A MOTOR POSITIONED THEREON

[76] Inventor: Carl Anderson, 1011 Capouse Ave., Scranton, Pa. 18509

[21] Appl. No.: 698,567

[22] Filed: Aug. 15, 1996

[51] Int. Cl.[6] ..... B63B 1/22

[52] U.S. Cl. ..... 114/285; 440/6; 440/3

[58] Field of Search ..... 440/53, 61, 63, 440/3, 5, 6, 66, 71, 72; 114/285–287, 284

[56] References Cited

U.S. PATENT DOCUMENTS

| | | | |
|---|---|---|---|
| 1,898,973 | 2/1933 | Lansing | 440/6 |
| 2,886,462 | 5/1959 | Jagiel . | |
| 4,200,055 | 4/1980 | Siegel | 440/5 |
| 4,832,642 | 5/1989 | Thompson . | |
| 4,995,839 | 2/1991 | Havins . | |
| 5,017,165 | 5/1991 | Havins . | |
| 5,058,520 | 10/1991 | Fahrney | 114/285 |
| 5,207,604 | 5/1993 | McMillin . | |

*Primary Examiner*—Edwin L. Swinehart
*Attorney, Agent, or Firm*—Helfgott & Karas, P.C.

[57] ABSTRACT

A propulsion apparatus for coupling to the stern of a boat is provided having at least one afterplane attached to the stern. At least one motor is positioned onto each corresponding afterplane, where each motor has a propeller positioned above the top surface of the afterplane, such that the propeller does not extend substantially beyond the peripheral boundaries of the afterplane to protect the propeller. Each afterplane may be pivotally raised or lowered so that during operation of the motor, the axis of the propellers are parallel with the plane of the water for propelling the boat. The afterplanes may also be pivotally raised or lowered for planing the boat.

18 Claims, 2 Drawing Sheets

PIVOTAL AFTERPLANE HAVING A MOTOR POSITIONED THEREON

FIELD OF THE INVENTION

The invention relates generally to a propulsion and stabilization apparatus, and, more particularly, to a pivotal afterplane having a motor positioned thereon for coupling to the stern of a motorboat.

BACKGROUND OF THE INVENTION

Afterplanes or "trim tabs" are common on all motorboats up to 60' in length. A typical afterplane configuration includes a pair of port and starboard afterplanes, each hinged to the bottom portion of the transom, located at the stern of the boat. Each afterplane pivots up and down, via hydraulic pistons or the like, that are attached at one end to the afterplane and at the other end to the transom. The purpose of attaching such afterplanes to a boat is for stabilization as it travels across the water. For example, the stern of a motorboat that does not utilize afterplanes will settle in the water creating a "wall" of water that, during acceleration, the bow must push through. Afterplanes, however, help avoid this unnecessary upward or listing altitude of the bow of the boat.

Typically, during acceleration of the boat from a standstill or near standstill position, the boat operator lowers the afterplanes to a downward position, with respect to the stern of the boat, using a toggle or push-button switch. This downward position forces water against the underside of the afterplanes which consequently raises the stern of the boat while lowering the bow to help maintain the boat in a "plane" position. Once the boat is at cruising speed, the operator raises the afterplanes to a substantially horizontal position to sustain the boat in the desired planing position. Maintaining a boat on a plane is especially important with respect to high performance speedboats for substantially lowering the risk of flipping over the speedboat during hard acceleration. Such flipping may occur when the afterplanes are positioned too low in the water.

The starboard and port afterplanes may typically be operated independently from one another. This is desired when there is an imbalance of weight in the boat. For example, if the majority of the boat passengers are on the port side of the boat, the starboard side will raise up causing the boat to tilt. With afterplanes, the driver can lower only the port afterplane which, in turn, raises the port side to balance the boat.

A boat that is properly balanced in a plane position allows the main boat motors to work more efficiently since their propellers will be substantially parallel to the water surface. Further, a planed boat provides a smoother ride by preventing inherent "porpoising" of the boat, while increasing driver visibility.

Powering such motorboats are typically provided by single or twin screw inboard, outboard or inboard/outboard engines. However, fishing boats and the like often use auxiliary power for trolling speeds, via trolling motors.

Trolling motors are designed to be operational when the main engines are off. They provide quick and precise bursts of speed when fishing, so that the fisherman can easily and quickly follow a fish. Since trolling motors provide less power than the main engines and are often powered electrically, they are quieter and generate far less vibration. This is advantageous, since it prevents "spooking" the fish that the main engines may cause.

Trolling motors are usually attached either to the bow, where the trolling motor pulls the boat, or to the stern, where the motor pushes the boat. With respect to the trolling motors attached to the stern, it is known that a pair of trolling motors may be attached, one motor on the starboard side and the other motor on the port side. This configuration helps to prevent fishing line entanglement, vis-à-vis, trolling motors that are attached to the bow. Further, aesthetically speaking, trolling motors attached to the stern are less of an "eye sore" than trolling motors attached to the bow.

It is also known to have various types of motors fixedly attached on the top surface of a hydrofoil. For example, U.S. Pat. Nos. 4,995,839 and 5,017,165 of Havins describe a boat having a main motor attached to the center of the boat transom and a trolling motor attached to the port side of the transom. The trolling motor is directly mounted on top of a hydrofoil. The hydrofoil can be hydraulically positioned in an up-position when the main motor is operating and a down-position when the trolling motor is operating. However, the hydrofoil does not behave as a trim tab but rather the hydrofoil is used to automatically raise the trolling motor when the main motor is engaged. Thus, when the main motor is engaged the hydrofoil is forced out of the water at the same time raising the trolling motor with no planing effects realized.

An example of a prior art system having a pair of motors mounted onto a pair of corresponding trim tabs, is found in U.S. Pat. No. 4,832,642 of Thompson. In this system, a pair of pedal motors are directly mounted on the top surface of a hydraulic trimming vein located on opposite sides of the stern. However, as shown in FIG. 4 of Thompson, a portion of the blades of each pedal motor remains below the trimming vein, and thus is susceptible to damage when the boat travels in shallow waters. Further, the trimming veins described in Thompson are substantially the same size as the pedal motors and thus, offer little protection of the motors, as opposed to an elongated trimming vein.

Another prior art system describing a pair of trim tabs, is described in U.S. Pat. No. 2,886,462 of Jagiel. This reference describes a singe outboard motor which is mounted on a frame that includes a pair of extending fins which act as trim tabs. Here, however, the fins use the force of the water to adjust and maintain the position of the outboard motor helping to plane the boat when the motor is engaged. Also the motor is positioned between the fins, offering no protection against potential damage to the propellers.

It is therefore an object of the present invention to provide at least one motor positioned onto an afterplane such that the propeller of the motor does not extend substantially beyond the peripheral boundaries of the afterplane.

Another object of the invention is to provide at least one motor positioned onto an afterplane, such that the afterplane has a cut-out portion for permitting water flow therethrough.

A further object of the invention is to provide at least one motor positioned onto an afterplane, such that each afterplane has an elongated shape to provide greater protection of the propeller.

A still further object is to provide in combination an afterplane and trolling motor which allows the operator of a boat to engage a main engine without a need for raising the trolling motor.

Various other objects, advantages and features of the present invention will become readily apparent from the ensuing detailed description and the novel features which will be particularly pointed out in the appended claims.

SUMMARY OF THE INVENTION

These and other objectives are realized by a propulsion apparatus for coupling to the stern of a boat having at least one afterplane attached to the stern. Further, at least one motor is positioned onto the corresponding at least one afterplane, where each motor has a propeller positioned above the top surface of the afterplane such that the propeller does not extend substantially beyond the peripheral boundaries of the afterplane to protect the propeller. Each afterplane may be pivotally raised or lowered so that during operation of the motor, the axis of the propellers are parallel with the plane of the water. The afterplanes may also be pivotally raised or lowered for planing the boat.

As a further aspect of this invention, each afterplane has a leading edge that is coupled to the stern of the boat and a front end section having the corresponding motor positioned thereon. Further, each afterplane has a back end section having a cut-out portion to permit waterflow therethrough for reducing cavitation of the water on the underside of each afterplane.

As an additional aspect of this invention, each afterplane has an elongated shape to provide greater protection of the propeller of the motor.

In a first embodiment of this invention, a boat having trolling capabilities includes at least one afterplane coupled to the stern of the boat. Further, at least one motor is positioned onto the corresponding at least one afterplane, where each motor has a propeller positioned above the top surface of the afterplane such that the propeller does not extend substantially beyond the peripheral boundaries of the afterplane to protect the propeller. Each afterplane may be pivotally raised or lowered so that during operation of the motor, the axis of the propellers are parallel with the plane of the water. The afterplanes may also be pivotally raised or lowered for planing the boat.

As a further aspect of this embodiment, each afterplane has a leading edge that is coupled to the stern of the boat and a front end section having a corresponding motor positioned thereon. Further, each afterplane has a back end section having a cut-out portion to permit waterflow therethrough reducing cavitation of the water on the underside of each afterplane.

As an additional aspect of this embodiment, each afterplane has an elongated shape to provide greater protection of the propeller of the motor.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION OF THE PREFERRED EMBODIMENTS

Figure 1:
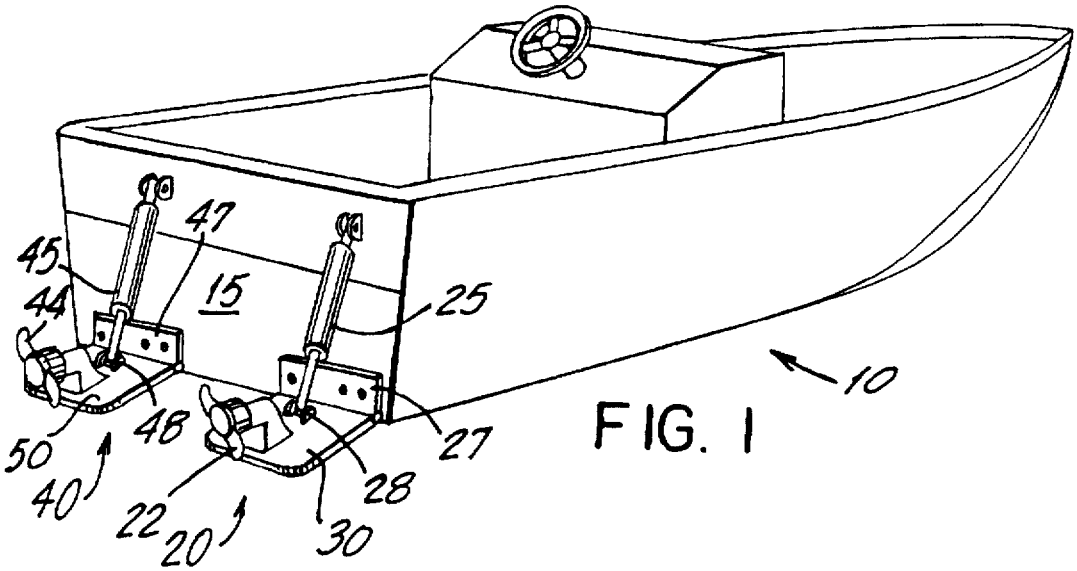
FIG. 1 is a starboard side perspective view of a boat having a pair of propulsion apparatus in accordance with a first embodiment of the present invention.
Figure 2:
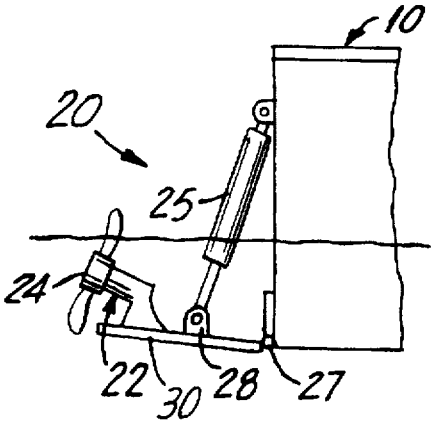
FIG. 2 is a partial, starboard side perspective view of the boat shown in FIG. 1 showing the afterplanes of the propulsion apparatus in an upward position.
Figure 3:
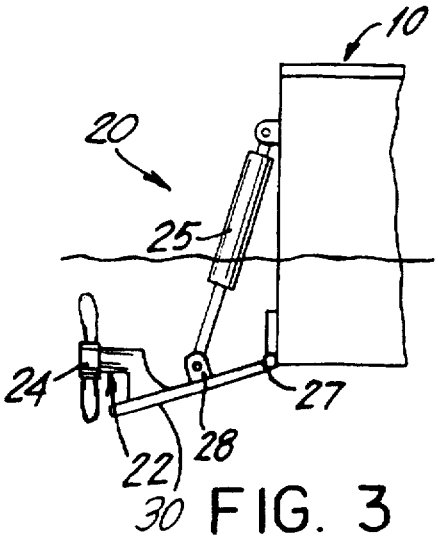
FIG. 3 is a partial, starboard side perspective view of the boat shown in FIG. 1 showing the afterplanes of the propulsion apparatus in a downward position.
Figure 4:
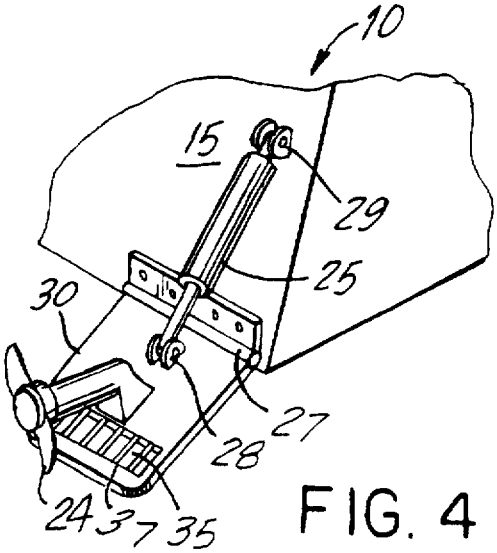
FIG. 4 is a partial, rear perspective view of the boat shown in FIG. 1 showing the elongated afterplane of the starboard side propulsion apparatus having a water flow cut-out in accordance with an aspect of the first embodiment.
Figure 5:
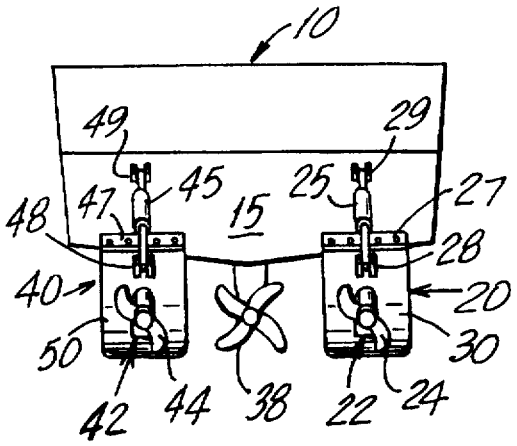
FIG. 5 is a rear elevational view of the boat shown in FIG. 1 having a pair of propulsion apparatus and a single main motor in accordance with an aspect of the first embodiment.

As seen in FIGS. 1–6, a pair of propulsion apparatus 20, 40 that are coupled to a motorboat 10 as illustrated, in accordance with a first embodiment of the present invention. Propulsion apparatus 20, includes an afterplane or trim tab 30 having a leading edge 32 that is coupled to the lower part of the stern or transom 15 of motorboat 10 via rotatable hinge 27. As best seen in FIG. 5, propulsion apparatus 20 is coupled to the starboard side of stern 15. Propulsion apparatus 40, however, is coupled to the port side of stern 15 and is essentially similar to propulsion apparatus 20. Therefore, propulsion apparatus 40 will not be described in detail.

Referring back to propulsion apparatus 20, rotatable hinge 27 is preferably integrated with afterplane 30 at one end and coupled to stern 15, via screws 18, at the other end. Alternately, rotatable hinge 27 may be fixedly attached to stern 15 by other conventional methods, such as welding and the like. Afterplane 30 may be rotatably raised or lowered around rotatable hinge 27, preferably via hydraulic piston 25. Other automated or manual devices may be used as well. Hydraulic piston 25 is coupled at one end to afterplane 30 by mounting bracket 28 and coupled at the other end to stern 15 by mounting bracket 29.

Afterplane 30 has a motor 22 positioned thereon. Motor 22 is preferably a conventional electric or fuel trolling motor and includes propeller 24. Each trolling motor may have less than one horsepower to as many as forty to fifty horsepower, or more, depending on the size of the boat.

Propulsion apparatus 40 includes afterplane 50 coupled to stern 15 via rotatable hinge 47. Trolling motor 42, having propeller 44, is positioned thereon. Piston 45 is coupled to the afterplane, via mounting brackets 48, 49.

As seen in FIG. 5, a main motor 38 is located at the bottom center portion of stern 15. However, motor 38 depicts only the main motor propeller, as the remainder of main motor 38 is housed internally (not shown). Although main motor 38 is illustrated as an inboard motor, the main motor may be an outboard or an inboard/outboard motor as well.

FIG. 4 shows an aspect of the first embodiment, where afterplane 30 includes a cut-out portion 35 located at the back end section near the piston. Afterplane 50 may also include such a cut-out (not shown). The purpose of cut-out 35 is to prevent water cavitation on the underside of the downward positioned afterplanes that subsequently produce unwanted drag. However in most instances, cut-out 35 is not necessary, as will be described in greater detail hereinlater.

For example, when motorboat 10 is at cruising speed, the afterplanes are typically in a raised, substantially horizontal position and do not suffer from substantial water drag. Further, when motorboat 10 is moving at slow or trolling speeds, i.e. the trolling motors are operational, and the afterplanes are in their downward angled position, drag is not a large concern due to the low force of water against the underside of the afterplanes.

As a further precaution against possible damage to the motor, cut-out portion 35 may have mounted thereto a plurality of rigid members 37 for preventing large objects or debris from passing through the cut-out during operation of the boat while the afterplanes are in their downward angled position.

Motorboat 10 is preferably a fishing type boat that utilizes auxiliary trolling motors in conjunction with single or twin screw motors. However, propulsion apparatus 20 and 40 may be coupled to any type of watercraft.

In operation, motorboat 10 generally has two modes of propulsion. The first mode utilizes trolling motors 22, 42 and the second mode utilizes main motor 38. For example, suppose that the operator of motorboat 10 wishes to navigate the boat docked at the edge of a lake to its center where the operator wishes to fish. Given this scenario, the operator would first rotate afterplanes 30 and 50 to its full downward position by moving afterplane toggle switches (not shown), or the like, downward, so as to extend pistons 25 and 45.

Once afterplanes 30 and 50 are in their full downward position, the operator may engage main motor 38. During acceleration, the downward angle of afterplanes 30 and 50 help raise the stern and lower the bow of boat 10 for maintaining the boat in a plane position. Once motorboat 10 has reached its cruising speed, the operator generally will move the afterplane toggle switches to its forward position to raise afterplanes 30 and 50 to a substantially horizontal position. Of course, in shallow water, the operator may engage trolling motors 22 and 42 instead of main motor 38 to protect the main motor from hitting the floor of the lake. In this regard, if the main motor is an outboard or an inboard/outboard motor, the motor may be tilted upwards for further protection.

When the motorboat is in the area where the operator intends to fish, main motor 38 is disengaged and the operator once again lowers afterplanes 30 and 50 to its full downward position using the afterplane toggle switches. Accordingly, the afterplanes are now in the same downward position that was used during the acceleration of the boat for planing. Now, however, the afterplanes are brought downward so that the axis of propellers 24 and 44 of motors 22 and 42, respectively, are in parallel with the plane of the water. The operator may now engage trolling motors 22, 42 as desired, for quick bursts of speed or maneuvering the boat in the direction of the fish. For example, to turn the boat quickly to the left, the starboard motor 22 is put into forward, while the port motor 42 is put into reverse.

An obvious benefit of the configuration of this invention is that with the afterplanes 30, 50 already in the downward position the operator may engage the main motor without raising the trolling motors. As the afterplanes are in the downward position the operator may accelerate the boat and have the boat maintain a plane position and as before only raise afterplanes 30, 50 and trolling motors after having reached cruising speed.

Moreover, it is apparent that while afterplanes 30, 50 are in their full downward position (FIG. 3) and motors 22, 42 or the main motor 38 are operational, that propellers 24, 44 are protected from damage by unexpected rocks and the like which may hit the bottom of the boat, when maneuvering boat 10 in any depth water. Any obstacles on the bottom of the water will contact the underside of afterplanes 30, 50 and not propellers 24, 44.

Figure 6:
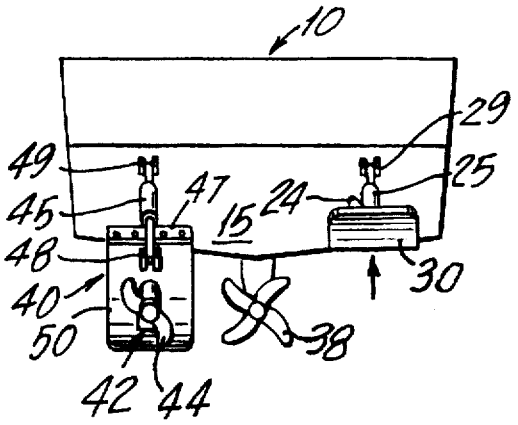
FIG. 6 is a partial, starboard side perspective view of the boat shown in FIG. 1 showing the propulsion apparatus when one afterplane is positioned upwards and the other afterplane is positioned downwards in accordance with an aspect of the first embodiment.

Further it should be noted that when main motor 38 is operational, trolling motors 22, 42 are not, and also that afterplanes 30, 50 function as conventional afterplanes or trim tabs in that they may rotate independently from one another. Thus, as shown in FIG. 6, afterplane 30 may be in an upward position while afterplane 50 may be in a downward position. Such a configuration is desirable for balancing boat 10 when its starboard side is weighted down.

Figure 7:
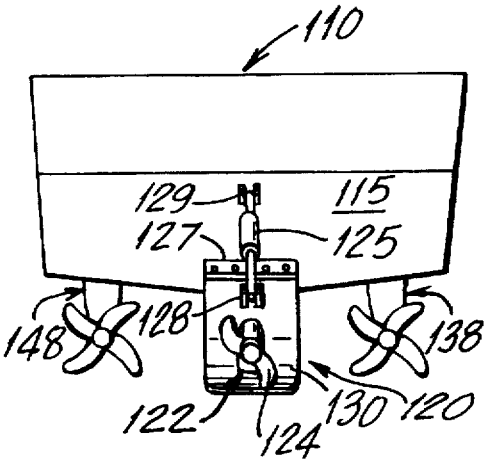
FIG. 7 is a rear elevational view of a boat having a single propulsion apparatus and a pair of main motors in accordance with a second embodiment of the present invention.

FIG. 7 shows propulsion apparatus 120 coupled to motorboat 110 in accordance with a second embodiment of the present invention. In this embodiment, a single afterplane 130 is coupled to stern 115 via a rotatable hinge 127. In contrast to the embodiment shown in FIG. 5, trolling motor 122 having propeller 124 is now positioned in the center of 115, while main motors 138, 148 are positioned on the starboard and port sides of the boat, respectively. This embodiment depicts the so called twin screw motorboat where both main motors 138, 148 are operational during normal acceleration and cruising. Similarly, trolling motor 122 is operational, for example, when fishing. Afterplane 130, operates in substantially the same manner as described with reference to afterplanes 30, 50 and is similarly pivotally rotatable around hinge 127 by piston 125 coupled to the afterplane and to the stern via mounting brackets 128 and 129, respectively. Additionally, afterplane 130 may contain a cut-out similar to cut-out 35 shown in FIG. 4.

However, unlike the embodiment of FIG. 5, steering of the boat is either provided by the main engine rudders (not shown) or by having trolling motor 122 pivotally positioned on afterplane 130, such that the trolling motor may pivot over a range of 180°.

For example trolling motor 122 would pivot fully to the left for sharply turning the boat to the left in forward or to the right in reverse. Similarly, trolling motor 122 would pivot fully to the right for sharply turning the boat to the right in forward or to the left in reverse.

Figure 8:
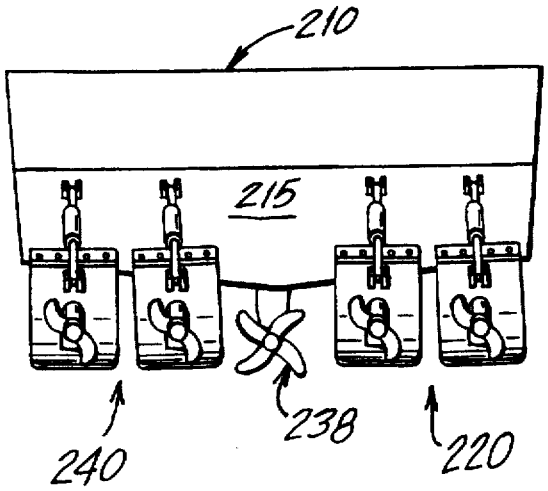
FIG. 8 is a rear elevational view of a boat having two pairs of propulsion apparatus and a single main motor in accordance with a third embodiment of the present invention.

FIG. 8 shows a first pair of propulsion apparatus 220 and a second pair of propulsion apparatus 240 coupled to the stern 215 of motorboat 210 in accordance with a third embodiment of the present invention. This third embodiment is also similar to the first embodiment, however, instead of a single afterplane coupled on each side of the boat, a pair of afterplanes 220, 240 are coupled to each side. The operation of the embodiment shown in FIG. 8 is substantially the same as the operation described in FIG. 5 except that the embodiment of FIG. 8 provides stronger trolling propulsion for higher trolling speeds and quicker maneuvering. Further, greater planing capabilities are realized when the afterplanes of apparatus 220, 240 are operated as trim tabs. The main motor 238 operates substantially the same as main motor 38 in FIG. 5.

While several embodiments have been chosen to illustrate the invention, it will be understood by those skilled in the art that various changes and modifications can be made herein without departing from the scope of the invention as defined in the appended claims.

What is claimed is:

1. A secondary propulsion apparatus for use with a boat having a primary motor means, said apparatus comprising:

at least one afterplane;

means for coupling each said afterplane to the stern of said boat;

at least one trolling motor, said at least one trolling motor being engaged independently of said main motor;

means for mounting each said trolling motor to a top surface of each said afterplane so that each said trolling motor is positioned above the top surface of each said afterplane and such that each said trolling motor does not extend substantially beyond the peripheral boundaries of each said afterplane; and means for pivotally raising and lowering each said afterplane from an upper position whereby each said afterplane is substantially parallel to the surface of the water to a downward angled position for maintaining the boat in a plane position and whereby when each said afterplane is in the downward position either said at least one trolling motor of said secondary propulsion apparatus or said primary motor means may be engaged to pilot said boat.

2. The propulsion apparatus of claim 1, wherein each said afterplane comprises a leading edge adapted to be coupled to said stern, a front end section having each said trolling motor positioned thereon, and a back end section.

3. The propulsion apparatus of claim 2, wherein each said afterplane has an elongated shape to provide greater protection of each said propeller and said back end section comprises a cut-out portion for permitting water flow therethrough to prevent cavitation of said water around each said afterplane.

4. The propulsion apparatus of claim 1, wherein said means for pivotally raising and lowering the position of each said afterplane includes at least one hydraulic piston having a first end fixedly attached to the top surface of each said afterplane and a second end adapted to be fixedly attached to the stern of said boat.

5. The propulsion apparatus of claim 1, wherein said means for coupling includes a rotatable hinge.

6. The propulsion apparatus of claim 1, wherein said at least one afterplane comprises a first and second afterplane, said first and said second afterplanes adapted to be coupled at opposite ends of said stern.

7. The propulsion apparatus of claim 6, wherein said at least one trolling motor comprises a first and second trolling motor said first trolling motor positioned on said first afterplane and said second trolling motor positioned on said second afterplane and wherein said main motor means comprises a single screw motor positioned at the center of said stern.

8. The propulsion apparatus of claim 7, wherein said first and said second trolling motors may be independently operated for steering said boat.

9. The propulsion apparatus of claim 1, wherein said at least one afterplane comprises first and second pairs of afterplanes, each pair adapted to be coupled at opposite ends of said stern.

10. The propulsion apparatus of claim 9, wherein said at least one motor comprises a first and second pair of trolling motors each of said first pair of trolling motors positioned on each of said first pair of afterplanes and each of said second pair of trolling motors positioned on each of said second pair of afterplanes and wherein the main motor means comprises a main single screw motor positioned at the center of said stern.

11. The propulsion apparatus of claim 10, wherein each pair of trolling motors may be independently operated for steering said boat.

12. The propulsion apparatus of claim 1, wherein said at least one afterplane comprises a single afterplane adapted to be coupled at the center of said stern.

13. The propulsion apparatus of claim 1, wherein said means for pivotally raising and lowering independently pivotally raises or lowers each said afterplane for planing and balancing said boat.

14. A boat having a main motor means and having trolling capabilities, comprising:

at least one afterplane;

means for coupling each said afterplane to said stern;

at least one trolling motor, each said trolling motor having a propeller means for mounting each said trolling motor to a top surface of each said afterplane such that each said propeller is positioned substantially above a top surface of each said afterplane and such that each said propeller does not extend substantially beyond the peripheral boundaries of each said afterplane; and means for pivotally raising and lowering each said afterplane whereby when each said afterplane is in a downward angled position for planing the boat the axis of each said propeller is substantially parallel with the surface of the water allowing for the engagement of either said main motor or each said trolling motor.

15. The boat of claim 14, wherein each said afterplane comprises a leading edge coupled to said stern, a front end section having said trolling motor positioned thereon, and a back end section having a cut-out portion for permitting water flow therethrough to prevent cavitation of said water around each of said afterplane.

16. The boat of claim 14, wherein each said afterplane has an elongated shape to provide greater protection of said propeller.

17. The boat of claim 14, wherein said means for pivotally raising and lowering includes at least one hydraulic piston having one end fixedly attached to the top surface of each said afterplane and the other end fixedly attached to the stern of said boat.

18. The boat of claim 14, wherein said means for pivotally raising and lowering selectively lowers and raises each said afterplane between an upper position whereby each said afterplane is substantially parallel to the surface of the water during non-operation of each said trolling motor to the downward angled position for planing and balancing said boat or for the operation of each said trolling motor.

* * * * *